US008156954B2

(12) United States Patent
Tao et al.

(10) Patent No.: US 8,156,954 B2
(45) Date of Patent: Apr. 17, 2012

(54) METHOD FOR REDUCTION OF CRUDE OIL VISCOSITY

(75) Inventors: Rongjla Tao, Cherry Hill, NJ (US); Xlaojun Xu, Glenside, PA (US); Ke Huang, Philadelphia, PA (US)

(73) Assignee: Temple University of the Commonwealth System of Higher Education, Philadelphia, PA (US)

( * ) Notice: Subject to any disclaimer, the term of this patent is extended or adjusted under 35 U.S.C. 154(b) by 0 days.

(21) Appl. No.: 11/792,553

(22) PCT Filed: Dec. 13, 2005

(86) PCT No.: PCT/US2005/044982

§ 371 (c)(1),
(2), (4) Date: Mar. 31, 2008

(87) PCT Pub. No.: WO2006/065775

PCT Pub. Date: Jun. 22, 2006

(65) Prior Publication Data

US 2008/0257414 A1 Oct. 23, 2008

Related U.S. Application Data

(60) Provisional application No. 60/636,127, filed on Dec. 15, 2004.

(51) Int. Cl.
*F17D 1/16* (2006.01)
*C10G 32/02* (2006.01)

(52) U.S. Cl. ..... 137/13; 204/554

(58) Field of Classification Search ..... 137/13, 137/827; 166/304, 248; 204/554, 563, 565, 204/573, 660, 672, 673
See application file for complete search history.

(56) References Cited

U.S. PATENT DOCUMENTS

| | | | | | |
|---|---|---|---|---|---|
| 2,083,798 | A | * | 6/1937 | Roberts | 204/563 |
| 2,083,799 | A | * | 6/1937 | Roberts | 204/563 |
| 3,304,251 | A | * | 2/1967 | Walker et al. | 204/560 |
| 3,496,837 | A | * | 2/1970 | Mceuen | 137/13 |
| 3,724,543 | A | * | 4/1973 | Bell et al. | 166/248 |
| 3,880,192 | A | | 4/1975 | Denizov et al. | |
| 4,037,655 | A | * | 7/1977 | Carpenter | 166/248 |
| 4,150,647 | A | | 4/1979 | Suzuki et al. | |
| 4,203,398 | A | | 5/1980 | Maruoka | |
| 4,204,923 | A | * | 5/1980 | Carpenter | 205/335 |
| 4,254,880 | A | | 3/1981 | Mangel | |
| 5,052,491 | A | | 10/1991 | Harms et al. | |

(Continued)

FOREIGN PATENT DOCUMENTS

| | | |
|---|---|---|
| DE | 40 29 056 | 10/1991 |
| RU | 2 196 919 | 1/2003 |

OTHER PUBLICATIONS

International Search Report corresponding to PCT/US2005/44982 dated Aug. 21, 2006.

(Continued)

*Primary Examiner* — John Rivell
(74) *Attorney, Agent, or Firm* — RatnerPrestia

(57) ABSTRACT

The present invention relates to a method for reducing the viscosity and facilitating the flow of petroleum-based fluids. The method includes the step of applying an electric field of sufficient strength and for a sufficient time to the petroleum-based fluid to cause a reduction in viscosity of the fluid.

20 Claims, 7 Drawing Sheets

U.S. PATENT DOCUMENTS

| | | | | |
|---|---|---|---|---|
| 5,234,170 | A | 8/1993 | Schirmer et al. | |
| 5,673,721 | A | 10/1997 | Alcocer | |
| 5,843,301 | A * | 12/1998 | Esztergar et al. | 208/309 |
| 6,167,871 | B1 | 1/2001 | Kumagai et al. | |
| 6,186,176 | B1 * | 2/2001 | Gelbmann | 137/827 |
| 2003/0102123 | A1 * | 6/2003 | Wittle et al. | 166/248 |

OTHER PUBLICATIONS

International Search Report for International Application No. PCT/US2007/022939 mailed Apr. 29, 2008.

Examination Report in GB0711091.9 mailed Oct. 28, 2008.

* cited by examiner

METHOD FOR REDUCTION OF CRUDE OIL VISCOSITY

This application is a U.S. National Phase Application of PCT International Application No. PCT/US2005/044982, filed Dec. 13, 2005, and claims priority of and U.S. Provisional Application 60/636,127, filed Dec. 15, 2004 each of which is incorporated by reference herein.

FIELD OF THE INVENTION

The present invention relates to petroleum-based fluids. More specifically, it relates to a method for reducing the viscosity and facilitating the flow of petroleum-based fluids.

BACKGROUND OF THE INVENTION

It is well known in the art that petroleum-based fluids, such as crude oil, have viscosity characteristics of liquid suspensions or emulsions. As a result, the three basic types of crude oil—paraffin-based, asphalt-based, and mixed-base (paraffin-based and asphalt-based mixed)—all exhibit the characteristic of increased viscosity corresponding to decreased fluid temperatures. In paraffin-based crude oil, as the temperature of the fluid decreases, especially when the temperature falls just below the temperature at which wax begins to precipitate (called the wax-appearance temperature), paraffin in the fluid crystallizes into many nanometer-sized particles which suspend in the solvent and increase the apparent viscosity of the fluid. In asphalt-based crude oil, asphalt in the fluid solidifies into an increasing number of asphaltene particles as the temperature decreases, resulting in a continuous increase in apparent viscosity. Mixed-based crude oil likewise demonstrates an inverse viscosity/temperature relationship similar to characteristics of both paraffin-based and asphalt-based crude oils. This inverse viscosity/temperature relationship is particularly problematic when the increase in viscosity fouls pipelines in which crude oil is transported.

In addition to the viscosity increase at lower temperatures, crude oil precipitates wax or asphaltene particles at lower temperatures, which is particularly problematic because of its detrimental effect on the transportation of crude oil via pipeline. As a result of crude oil wax or asphaltene precipitation, pipelines must be frequently shut down and cleaned to scrape out wax or asphaltene buildup in the piping to prevent obstruction of crude oil flow.

With increasing demands on world oil supplies and the low temperature climates, for example offshore oil wells and the Artic and sub-Arctic environs, in which oil is extracted or through which it is transported, it is increasingly important to develop methods for improving the flow of crude oil in pipelines at lower temperatures.

For the reasons described above, a method for decreasing viscosity and facilitating fluid flow of petroleum-based fluids, such as crude oil, is desirable.

SUMMARY OF THE INVENTION

According to the method of the present invention, there is provided a method for reducing the viscosity of petroleum based fluids. The method comprises applying to the fluid an electric field of sufficient strength and of a sufficient period of time to reduce viscosity of the fluid and applying that field for a time sufficient to facilitate improved flow of the fluid. The selection of an appropriate strength electric field and an appropriate time period for application of the field is necessary to produce a desired reduction in viscosity of the petroleum-based fluid and improvement in the flow thereof. The present invention is particularly useful in the transportation of crude oil through pipelines where improved fluid flow is desirable, and more specifically where cooler fluid temperatures cause increased fluid viscosity, and raising the fluid's temperature in order to reduce the viscosity is difficult to achieve.

BRIEF DESCRIPTION OF THE DRAWINGS

The invention is best understood from the following detailed description when read in connection with the accompanying drawing. It is emphasized that, according to common practice, the various features of the drawing are not rendered to scale. On the contrary, the dimensions of the various features are arbitrarily expanded or reduced for clarity. Included in the drawing are the following figures.

DETAILED DESCRIPTION OF THE INVENTION

Figure 1:
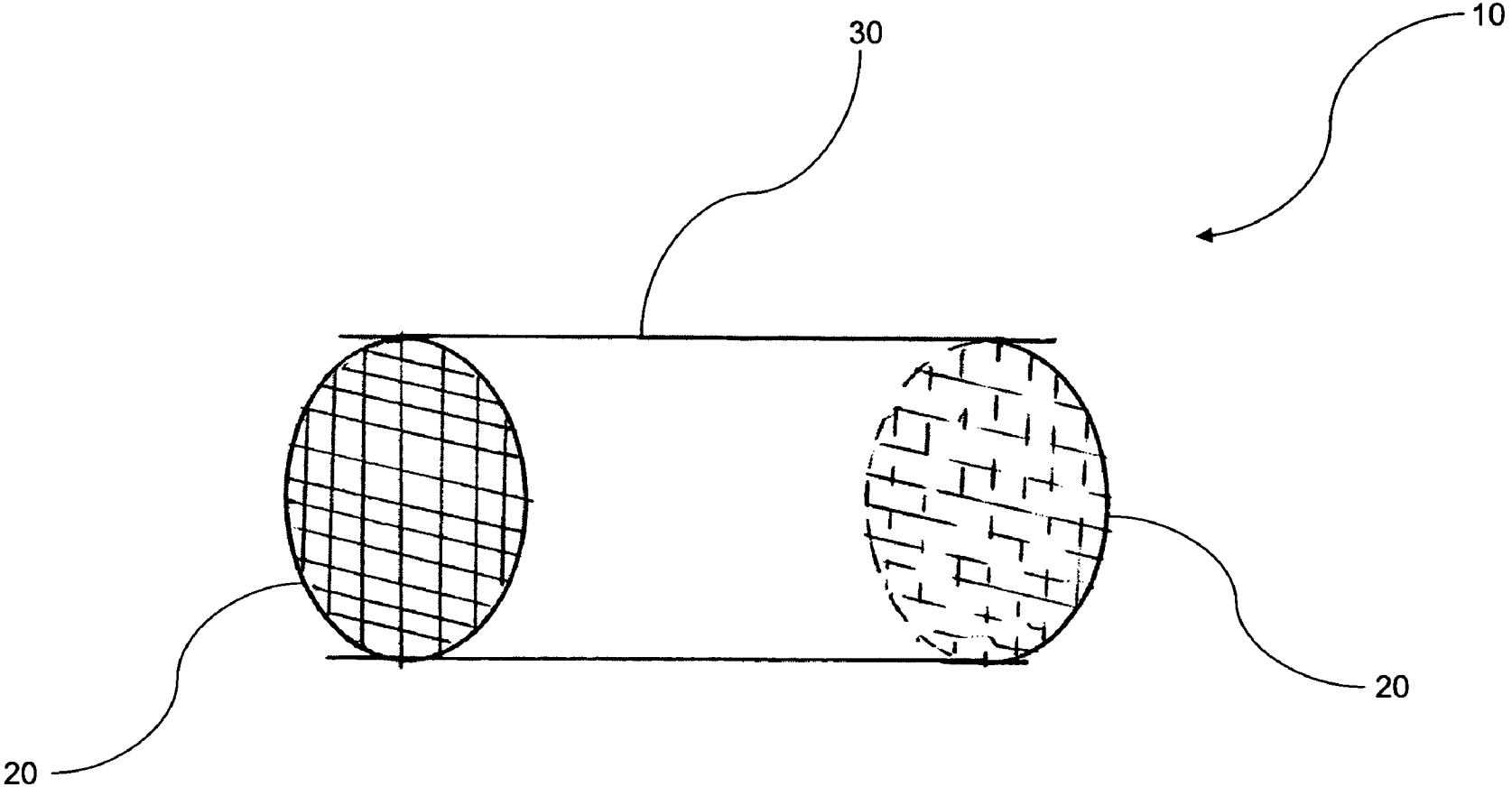
FIG. 1 is an illustration of a capacitor for applying an electric field in accordance with an embodiment of the invention.

The present invention provides a method for reducing viscosity and improving the flow of petroleum-based fluids, by applying to the fluid an electric field of sufficient strength and for a period of time sufficient to reduce viscosity of the fluid.

The method is directed to petroleum-based fluids, such as crude oil, but is not limited to this particular petroleum-based fluid. Thus the method is applicable, for example, to crude oil, including but not limited to paraffin based crude oil, asphalt based crude oil, mixed based crude oil (a combination of both paraffin-based and asphalt-based), and mixtures thereof. More particularly the present invention is directed to fluids which are too viscous, due at least in part to temperature considerations, to be easily transported or piped from one location to another.

It has been discovered that by applying an electric field to the fluid, viscosity of the fluid can be reduced to facilitate flow of the fluid and/or prevent precipitation of solids which might cause blockage or reduced flow through pipes or vessels through which the fluid must pass. In order to obtain a desired reduction in viscosity, the applied electric field must be of a strength of at least about 10 V/mm in order to produce a reduction in viscosity of the fluid. For example, the field strength may suitably be in the range of about 10 V/mm up to about 2000 V/mm, for example in the range of about 400 V/mm to about 1500 V/mm. The selection of a particular value within this range is expected to depend on the composition of the fluid, the desired degree of reduction in viscosity, the temperature of the fluid, and the period during which the field is to be applied. It will be appreciated that if the field strength is too low or the application period too short no significant change in viscosity will result. Conversely if the strength of the electric field is too high or the period of application too long, the viscosity of the fluid may actually increase.

As indicated above, the duration of exposure of the fluid to the electric field is also important in order to reduce the viscosity. The exposure period is suitably in the range of about 1 second to about 300 seconds, for example, about 1 second to about 100 seconds.

As the fluid continues its flow over extended periods of time, the viscosity following application of the field as described above will tend to increase slowly back toward its original value. It may therefore be necessary, in order to maintain a desired viscosity range, to reapply the electric field periodically at a point or multiple points downstream from the point at which the initial electric field was applied. For example, it may be desirable to reapply the electric field at intervals ranging, for example, from about 15 minutes to about 60 minutes as the fluid progresses along its path of travel to ensure that viscosity is always below a predetermined level. In crude oil applications, it may thus be desirable to locate electric fields at a series of points downstream from the initial point to the destination point. Since crude oil in a pipeline flows several miles per hour, applying an electric field at intervals every couple of miles would allow viscosity to be maintained below the predetermined value. The viscosity would continually be driven to the lower values by counteracting the rebounding that occurs as the crude oil flows through areas of the pipe not exposed to the electric fields.

By applying the electric field within these ranges of strength and period, nearby paraffin particles or asphaltene particles are forced to aggregate into larger particles that are limited to micrometer size, while not permitting enough time or strength to let these particles form macroscopic clusters. As the average particle size increases, the viscosity is reduced. Once the electric field is removed, the rate that the viscosity returns to its original value decreases over time as the aggregated particles gradually disassemble. It may take as long as about 8-10 hours for the viscosity to return to its initial value.

The electric field used may be a direct current (DC) or an alternating current (AC) electric field. When applying an AC electric field, the frequency of the applied field is in the range of about 1 to about 3000 Hz, for example from about 25 Hz to about 1500 Hz. This field can be applied in a direction parallel to the direction of the flow of the fluid or it can be applied in a direction other than the direction of the flow of the fluid.

The strength of the field and duration of the period of time the fluid is exposed to the field varies depending on the type of crude oil involved, such as paraffin-based crude oil, asphalt-based crude oil, mixed-based crude oil, or a mixture thereof. It has been determined that the higher the initial viscosity of the fluid before being subjected to the electric field, the greater the reduction in viscosity after being subjected to the electric field.

In one embodiment, the electric field is applied using a capacitor 10 wherein the crude oil flows through the capacitor 10, experiencing a short pulse electric field as a constant voltage is applied to the capacitor. The capacitor may be of the type which includes at least two metallic meshes 20 connected to a large tube 30, as illustrated in FIG. 1, wherein the crude oil passes through the mesh.

It will be appreciated by those skilled in the art that other types of capacitors may also be used. In this embodiment, the electric field is applied in a direction parallel to the direction of fluid flow. These types of capacitors can be used to generate pulse electric fields that can be applied to crude oil in pipelines.

In another embodiment, the electric field is generated by a capacitor across which the electric field is applied in a direction other than the direction of the flow of the fluid. It is contemplated that the electric field can be applied in almost any feasible direction across the fluid and still achieve a reduction in viscosity.

The following are examples that are illustrative of the invention:

EXAMPLE 1

Figure 2:
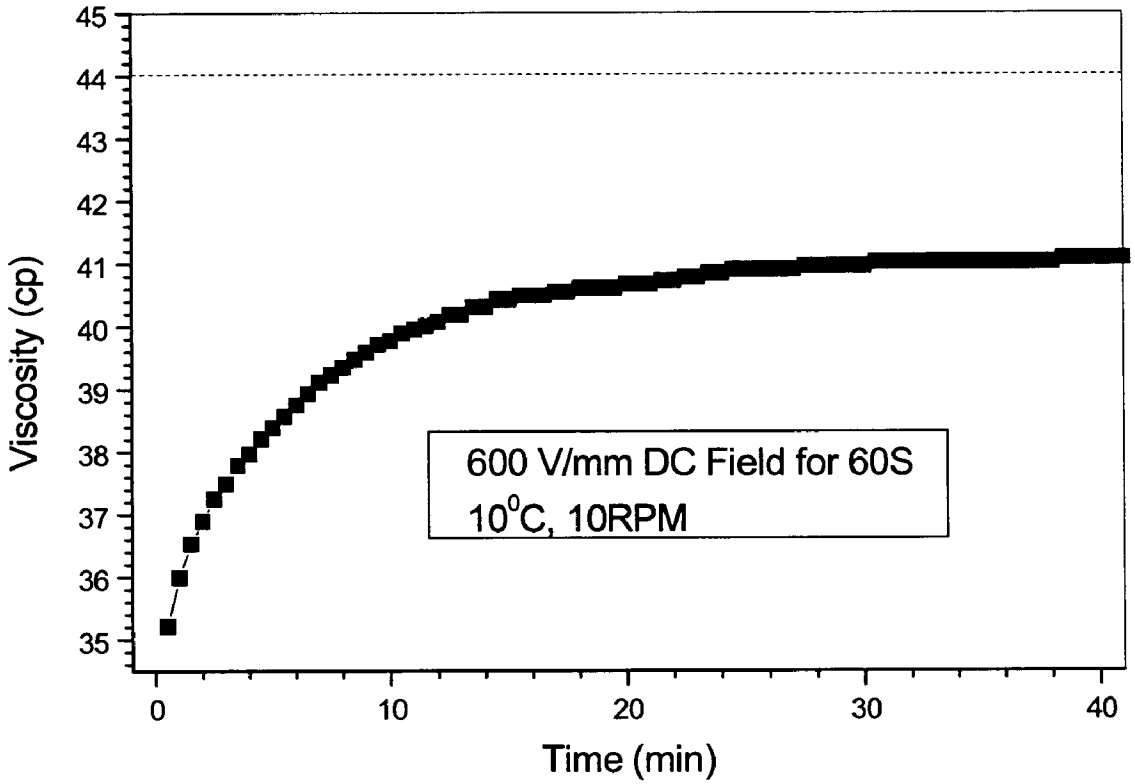
FIG. 2 is a graph of viscosity versus time for an oil sample in accordance with Example 1.

A DC electric field of 600 V/mm was applied to a paraffin-based crude oil sample for 60 seconds, which had an initial viscosity of 44.02 cp at 10° C. After exposure to the electric field, the viscosity dropped to 35.21 cp, or about 20% of its initial value. After the electric field was removed, the viscosity, as shown in FIG. 2, gradually increased. After about 30 minutes, the viscosity had climbed to 41 cp, still 7% below the original viscosity. The rate of viscosity increase after the first 30-minute period dropped considerably.

EXAMPLE 2

Figure 3:
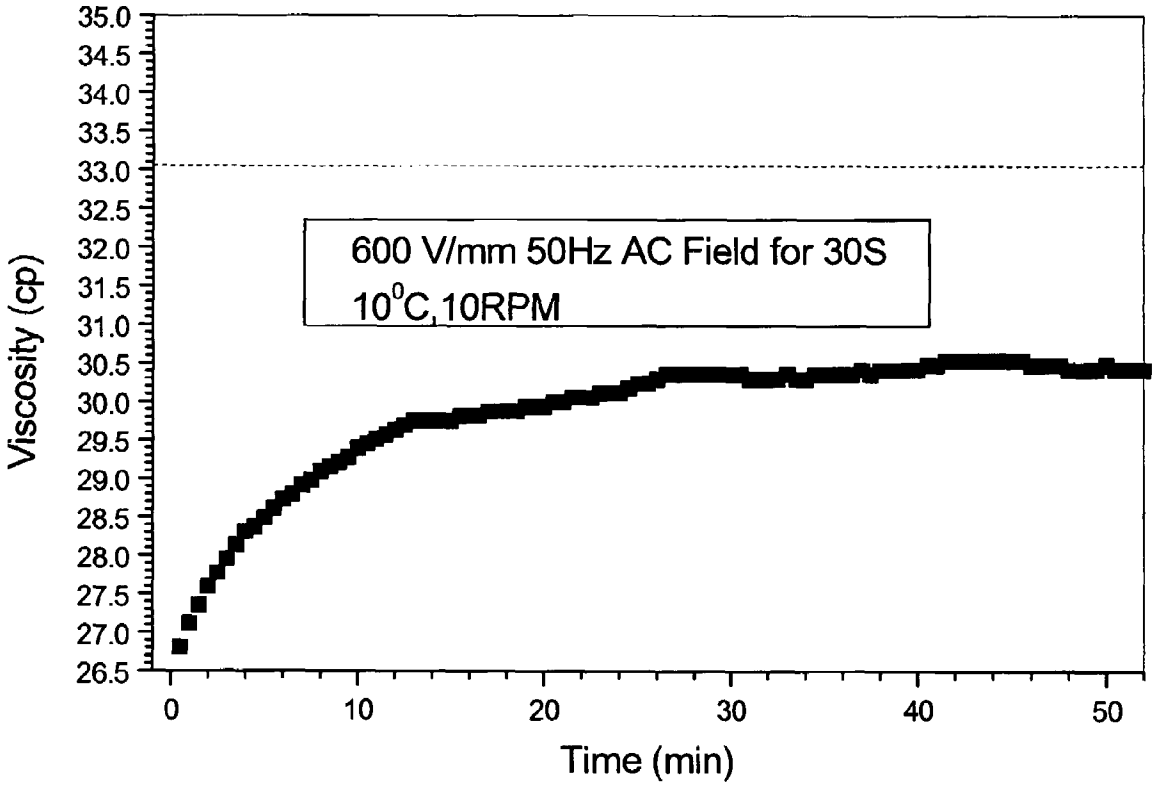
FIG. 3 is a graph of viscosity versus time for an oil sample in accordance to Example 2.

A paraffin-based crude oil sample with an initial viscosity of 33.05 cp at 10° C., was exposed to a 50-Hz AC electric field of 600V/mm for 30 seconds. The viscosity of the fluid dropped to about 26.81 cp, or 19% of the initial value. After 30 minutes, the viscosity climbed to only about 30 cp, still about 10% below the original value, as shown in FIG. 3.

The results as shown in Examples 1 and 2 indicate that both DC electric fields and low-frequency AC fields are effective in reducing the apparent viscosity of the crude oil samples tested. Experiments also revealed that it takes approximately 10 hours for the viscosity which has been reduced by the applied electric field to return to its original value.

EXAMPLE 3

Figure 4:
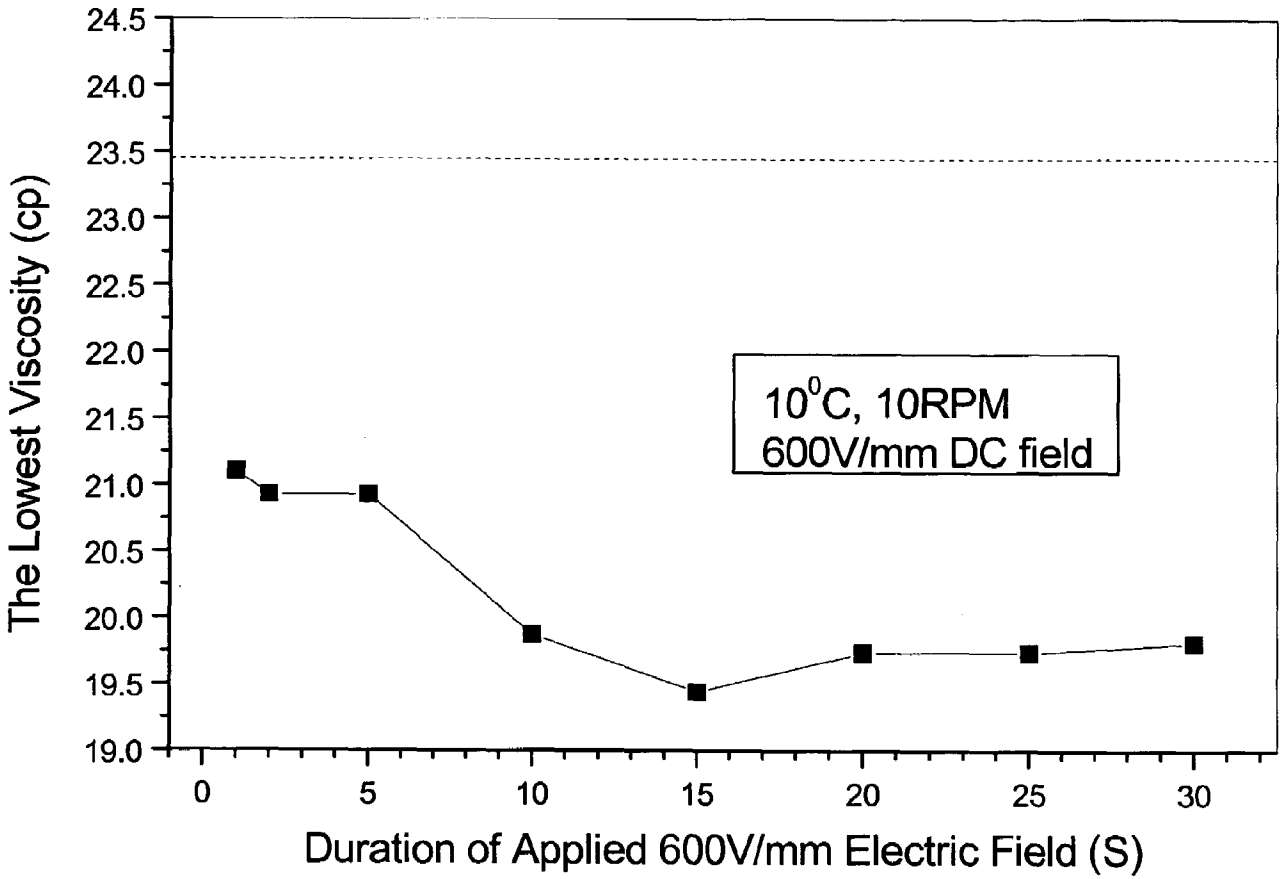
FIG. 4 is a graph of the lowest viscosity versus duration or an applied DC electric field strength of 600 V/mm for an oil sample in accordance with Example 3.

The duration of the applied electric field to the sample was determined for the optimal duration of the electric field. For the paraffin-based crude oil sample tested, the optimal duration was determined to be 15 seconds for an applied DC electric field strength of 600 V/mm. The lowest viscosity immediately after the electric field was applied was 19.44 cp, 17.1% down from the original viscosity value of 23.45 cp, before the electric field was applied, as shown in FIG. 4.

EXAMPLE 4

Figure 5:
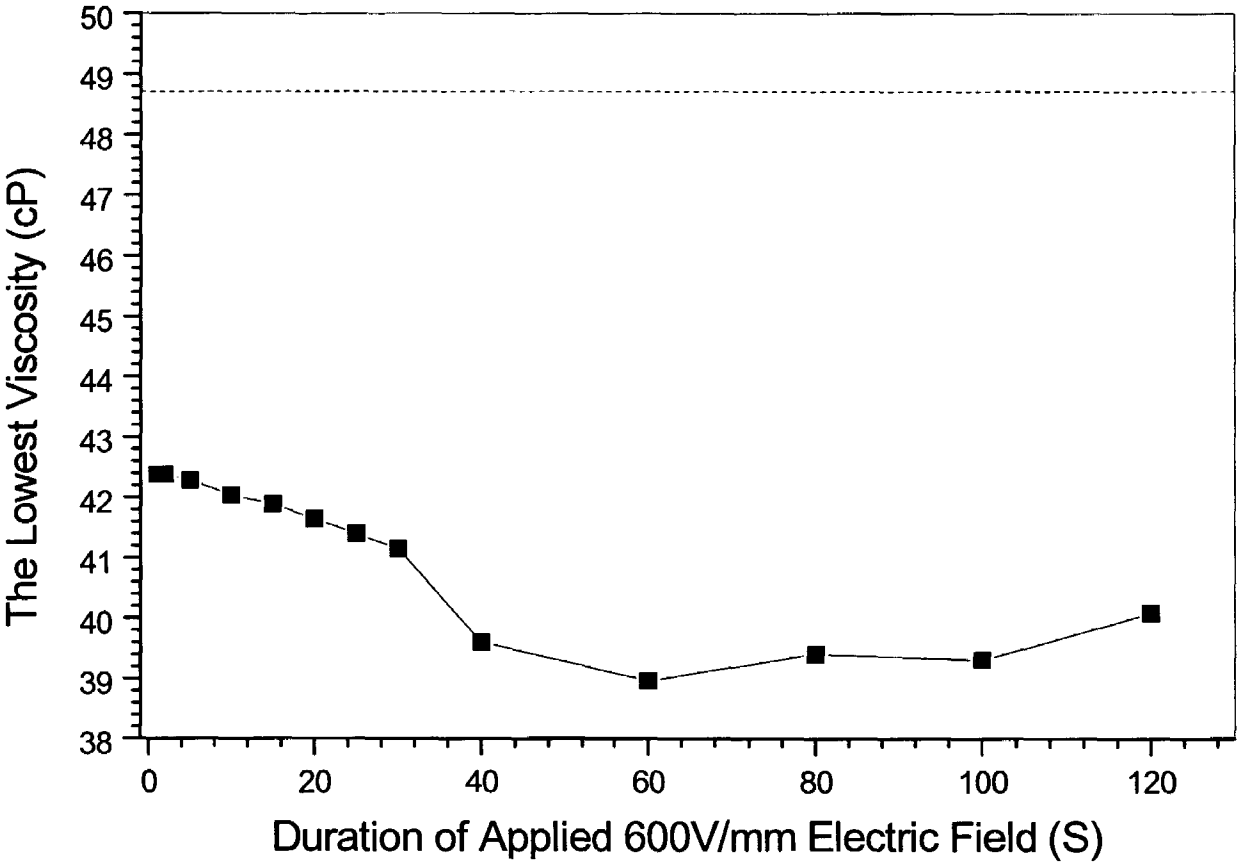
FIG. 5 is a graph of the lowest viscosity versus duration of an applied DC electric field strength of 600 V/mm for an oil sample in accordance with Example 4.

For a crude oil sample having a viscosity of about 44.02 cp at 10° C. before the electric field was applied, the optimal duration was found to be about 60 seconds using an electric field of 600 V/mm. The sample's viscosity dropped to about 35.21 cp, or 20%, for this time period, as is illustrated in FIG. 5. This result shows that the effect of the electric field gets stronger as the viscosity of crude oil gets higher.

EXAMPLE 5

Figure 6:
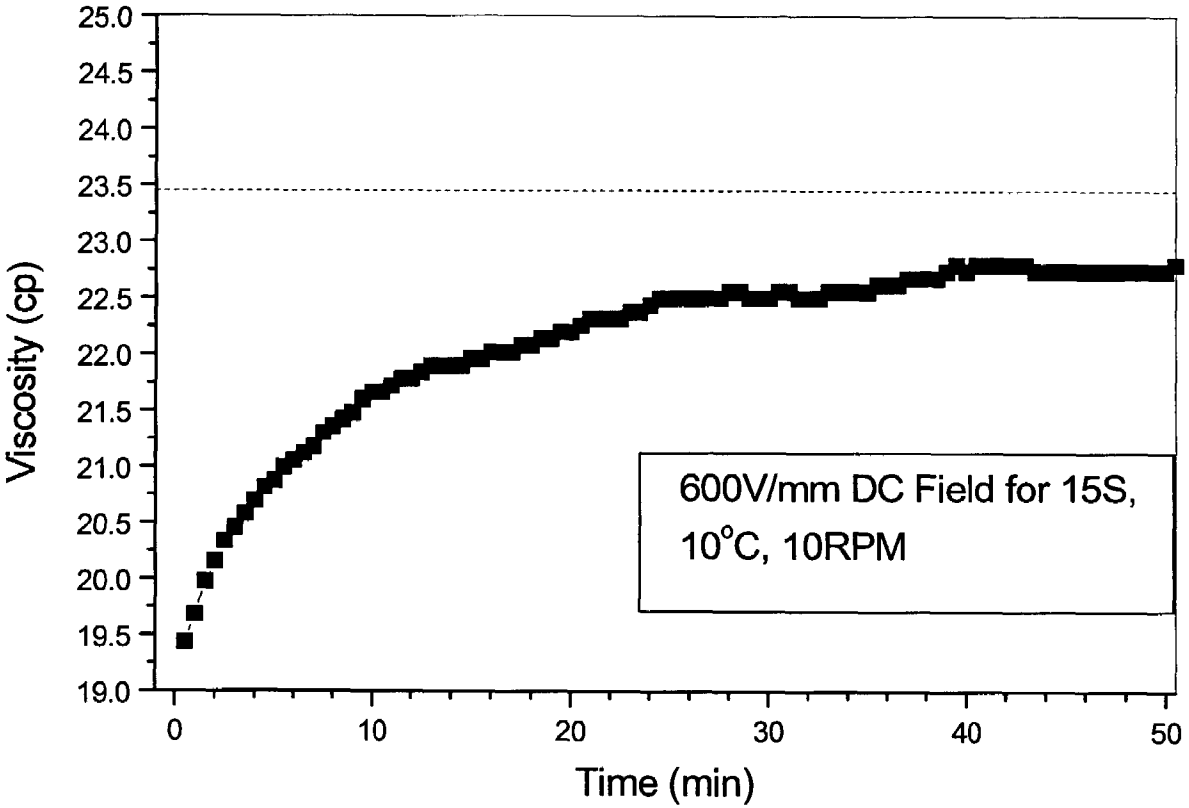
FIG. 6 is a graph of viscosity versus time for an oil sample in accordance with Example 5.

The graph shown in FIG. 6 is a plot of the results for the sample in Example 2 at its optimal duration. The crude oil originally had viscosity 23.45 cp. After application of a DC field of 600V/mm for 15 seconds, the viscosity dropped to 19.44 cp, down 4.01 cp, a 17.10% reduction. On the other hand, as shown in Example 1, the viscosity was down 8.81 cp, a 20% reduction.

EXAMPLE 6

Further experimentation in which samples of crude oil were tested at 10° and 20° revealed that the electric field's effect is stronger when the temperature of the fluid is lower. As the temperature is decreased, the volume fraction of paraffin particles gets higher; therefore, the apparent viscosity gets higher and the effect of the electric field on the fluid viscosity also becomes more pronounced. In Example 6, the paraffin-based crude oil was tested at both 20° C. and 10° C. and the results indicated that the electric field effect at 10° C. is stronger than that at 20° C. For example, at 20° C. the largest viscosity drop was less than 10%, while at 10° C. it was significantly higher than 10%.

EXAMPLE 7

Figure 7:
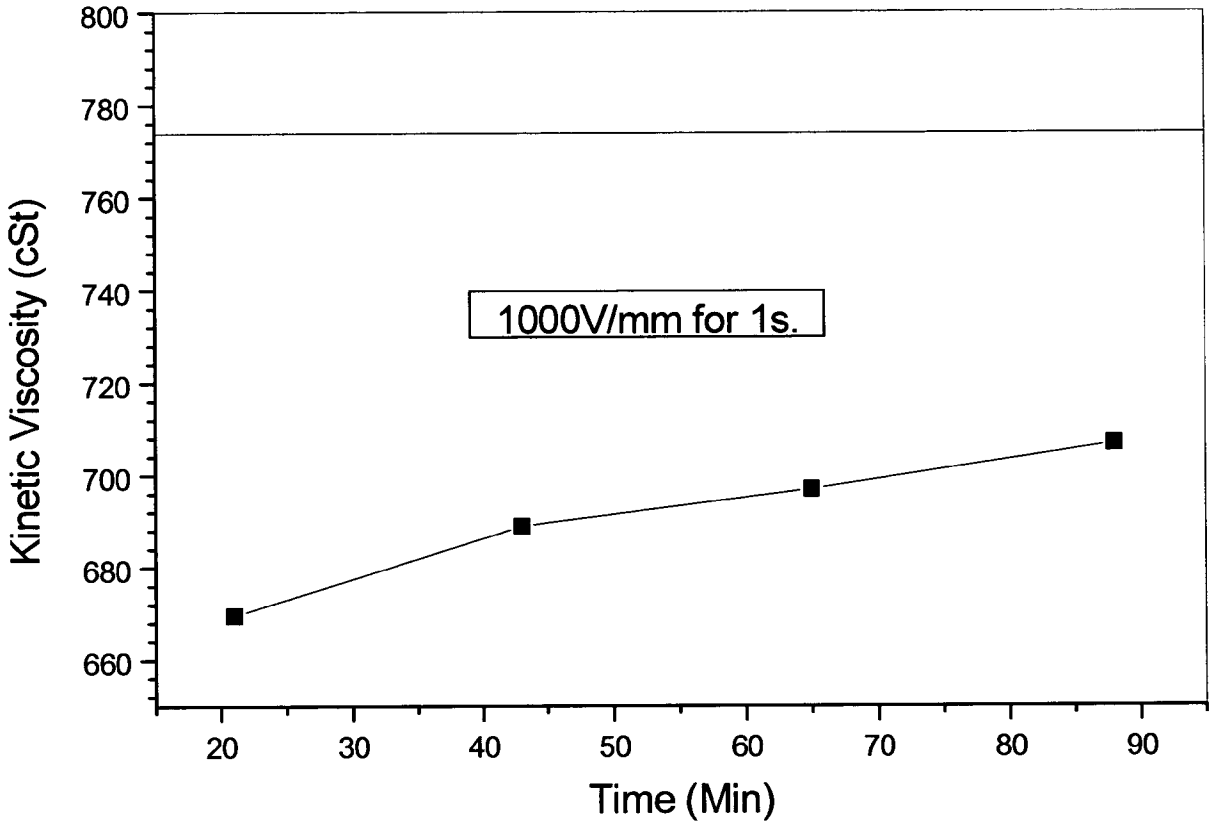
FIG. 7 is a graph of kinetic viscosity versus time for an oil sample in accordance with Example 7.

An asphalt-based crude oil sample at 23.5° C., having a kinetic viscosity 773.8 cSt, required about 8 seconds of exposure to an applied electric field of 1000 V/mm for viscosity reduction. In the sample, the kinetic viscosity immediately dropped to 669.5 cSt, down 104.3 cSt or approximately 13.5% After about 90 minutes, the kinetic viscosity was at 706.8 cSt, still 67 cSt below the original value. During the experiment, the temperature was maintained at 23.5° C. The results are shown in FIG. 7.

In comparing the effects of applying a magnetic field with the effects of applying an electric field to the asphalt-based crude oil, it was determined that the magnetic field had only a minimal effect on the viscosity of the sample, however, application of the electric field to the same sample reduced the viscosity of the asphalt-based crude oil significantly.

Another feature of the present invention is that it also slows the precipitation of wax from crude oil. As the nanoscale paraffin particles aggregate to micrometer-sized particles, the available surface area for crystallization is dramatically reduced. Thus, the precipitation of wax from crude oil is significantly decreased.

Although the invention is illustrated and described herein with reference to specific embodiments, the invention is not intended to be limited to the details shown. Rather, various modifications may be made in the details within the scope and range of equivalents of the claims and without departing from the invention. It is contemplated that the invention, while described with respect to crude oil, may be useful in other applications where increased petroleum-based fluid viscosity is problematic and inhibits flow of the fluid.

What is claimed:

1. A method for reducing viscosity of a petroleum-based fluid comprising the step of:

generating an electric field determined to reduce the viscosity of the petroleum-based fluid for transportation of the petroleum-based fluid; and applying the generated electric field along a flow direction of the petroleum-based fluid during transportation from a first location to a second location to aggregate at least one of paraffin or asphaltene particles in the petroleum-based fluid into an aggregate size that reduces the viscosity and improves flow of the petroleum-based fluid from the first location to the second location.

2. The method of claim 1 wherein the petroleum-based fluid is crude oil.

3. The method of claim 1 wherein the petroleum-based fluid is a paraffin-based crude oil or an asphalt-based crude oil or a mixed-base crude oil.

4. The method of claim 1 wherein the electric field is applied at a strength of at least 10 V/mm, which is sufficient to reduce the viscosity and to facilitate flow of the fluid.

5. The method of claim 1 wherein the electric field is applied for a period of about 1 to about 300 seconds, which period of application is sufficient to reduce viscosity and facilitate flow of the fluid.

6. The method of claim 1 wherein the electric field is applied at a strength of at least 10 V/mm and for a period of about 1 to about 300 seconds, which strength and period of application is sufficient to reduce the viscosity and facilitate flow of the fluid.

7. The method of claim 6 wherein the electric field is generated by a capacitor across which an electric field is applied in a direction parallel to the direction of the flow of the fluid.

8. The method of claim 7 wherein the capacitor comprises at least two metallic meshes connected to a tube.

9. The method of claim 1 wherein the electric field is applied at a strength of about 10 to about 2000 V/mm and for a period of about 1 to about 300 seconds, which strength and period of application is sufficient to reduce the viscosity and facilitate flow of the fluid.

10. The method of claim 1 wherein the electric field is selected from the group consisting of a direct current (DC) electric field and an alternating current (AC) electric field.

11. The method of claim 1 wherein the electric field is applied at a strength of about 10 to about 2000 V/mm and is applied for a period of about 1 to about 300 seconds.

12. The method of claim 1 wherein the electric field is an AC field having a frequency of about 1 to about 3000 Hz.

13. The method of claim 1, wherein the viscosity of the petroleum-based fluid is reduced while maintaining a temperature of the petroleum-based fluid.

14. The method of claim 1, wherein the reduced viscosity of the petroleum-based fluid is maintained after applying the electric field.

15. The method of claim 1, wherein the aggregate size is microscopic.

16. A method for reducing viscosity of a petroleum-based fluid comprising the steps of:

transporting petroleum-based fluid through a conduit from a first location to a second location;

generating an electric field along a flow direction of the petroleum-based fluid within the conduit, the generated electric field determined to reduce the viscosity of the petroleum-based fluid for transporting the petroleum-based fluid through the conduit from the first location to the second location; and flowing the petroleum-based fluid through the generated electric field to aggregate at least one of paraffin or asphaltene particles in the petroleum-based fluid into an aggregate size that reduces the viscosity and improves flow of the petroleum-based fluid from the first location to the second location.

17. The method of claim 16, wherein the generating step comprises generating an electric field within the conduit with a capacitor.

18. The method of claim 16, wherein the aggregate size is microscopic.

19. A method for reducing viscosity of crude oil comprising the steps of:

transporting the crude oil in a flow direction through a conduit from a first location to a second location; and generating an electric field along the flow direction of the crude oil within the conduit, the generated electric field determined to reduce the viscosity of the crude oil for transporting the crude oil through the conduit; and flowing the crude oil in the flow direction through the generated electric field to aggregate at least one of paraffin or asphaltene particles in the crude oil to reduce the viscosity and improve flow of the crude oil from the first location to the second location.

20. The method of claim 19, wherein the generating step comprises generating an electric field within the conduit with a capacitor.

* * * * *

UNITED STATES PATENT AND TRADEMARK OFFICE

CERTIFICATE OF CORRECTION

PATENT NO. : 8,156,954 B2
APPLICATION NO. : 11/792553
DATED : April 17, 2012
INVENTOR(S) : Rongjia Tao, Xiaojun Xu and Ke Huang It is certified that error appears in the above-identified patent and that said Letters Patent is hereby corrected as shown below:

On the Cover Page, item (75) under INVENTORS should read:

Rongjia Tao, Cherry Hill, NJ (US);
Xiaojun Xu, Glenside, PA (US);
Ke Huang, Philadelphia, PA (US)

Signed and Sealed this
Twenty-fourth Day of July, 2012

David J. Kappos

David J. Kappos
*Director of the United States Patent and Trademark Office*